US008944762B2

(12) United States Patent
Suciu et al.

(10) Patent No.: US 8,944,762 B2
(45) **Date of Patent: *Feb. 3, 2015**

(54) SPOKED SPACER FOR A GAS TURBINE ENGINE

(75) Inventors: Gabriel L. Suciu, Glastonbury, CT (US); Stephen P. Muron, Columbia, CT (US); Christopher M. Dye, San Diego, CA (US)

(73) Assignee: United Technologies Corporation, Hartford, CT (US)

( * ) Notice: Subject to any disclaimer, the term of this patent is extended or adjusted under 35 U.S.C. 154(b) by 596 days.

This patent is subject to a terminal disclaimer.

(21) Appl. No.: 13/283,733

(22) Filed: Oct. 28, 2011

(65) Prior Publication Data

US 2013/0108468 A1 May 2, 2013

(51) Int. Cl.
*F01D 5/06* (2006.01)
*F01D 11/00* (2006.01)

(52) U.S. Cl.
CPC ..... *F01D 11/005* (2013.01); *F01D 5/066* (2013.01); *F05D 2240/55* (2013.01)
USPC ..... 416/95; 416/198 A

(58) Field of Classification Search
USPC ..... 416/198 A, 198 R, 193 A, 95
See application file for complete search history.

(56) References Cited

U.S. PATENT DOCUMENTS

| | | | | | |
|---|---|---|---|---|---|
| 2,656,147 | A | * | 10/1953 | Brownhill et al. | 416/97 R |
| 3,894,324 | A | * | 7/1975 | Holzapfel et al. | 29/889.2 |
| 4,127,359 | A | * | 11/1978 | Stephan | 416/198 A |
| 4,329,175 | A | | 5/1982 | Turner | |
| 4,479,293 | A | | 10/1984 | Miller et al. | |
| 4,529,452 | A | | 7/1985 | Walker | |
| 4,659,289 | A | * | 4/1987 | Kalogeros | 416/198 A |
| 4,784,572 | A | * | 11/1988 | Novotny et al. | 416/213 R |
| 5,395,699 | A | | 3/1995 | Ernst et al. | |
| 5,409,781 | A | | 4/1995 | Rosler et al. | |
| 6,095,402 | A | | 8/2000 | Brownell | |
| 6,160,237 | A | | 12/2000 | Schneefeld et al. | |
| 6,478,545 | B2 | | 11/2002 | Crall et al. | |
| 6,524,072 | B1 | | 2/2003 | Brownell et al. | |
| 6,666,653 | B1 | | 12/2003 | Carrier | |
| 7,341,431 | B2 | | 3/2008 | Trewiler et al. | |
| 2009/0249622 | A1 | | 10/2009 | Schreiber | |

FOREIGN PATENT DOCUMENTS

| | | | | |
|---|---|---|---|---|
| FR | 2561307 | | | 9/1985 |
| GB | 805319 | | | 12/1958 |
| GB | 2416544 | | | 2/2006 |
| JP | 6-35807 | B2 | * | 2/1987 |
| WO | WO 2010/099782 | A1 | * | 9/2010 |

* cited by examiner

*Primary Examiner* — Liam McDowell
(74) *Attorney, Agent, or Firm* — Carlson, Gaskey & Olds, PC

(57) ABSTRACT

A spacer for a gas turbine engine includes a rotor ring defined along an axis of rotation and a plurality of core gas path seals which extend from the rotor ring, each of the plurality of core gas path seals extend from the rotor ring at an interface, the interface defined along a spoke.

16 Claims, 13 Drawing Sheets

SPOKED SPACER FOR A GAS TURBINE ENGINE

BACKGROUND

The present disclosure relates to a gas turbine engine, and more particularly to a rotor system therefor.

Gas turbine rotor systems include successive rows of blades, which extend from respective rotor disks that are arranged in an axially stacked configuration. The rotor stack may be assembled through a multitude of systems such as fasteners, fusion, tie-shafts and combinations thereof.

Gas turbine rotor systems operate in an environment in which significant pressure and temperature differentials exist across component boundaries which primarily separate a core gas flow path and a secondary cooling flow path. For high-pressure, high-temperature applications, the components experience thermo-mechanical fatigue (TMF) across these boundaries. Although resistant to the effects of TMF, the components may be of a heavier-than-optimal weight for desired performance requirements.

SUMMARY

A spacer for a gas turbine engine according to an exemplary aspect of the present disclosure includes a rotor ring defined along an axis of rotation and a plurality of core gas path seals which extend from the rotor ring, each of the plurality of core gas path seals extend from the rotor ring at an interface, the interface defined along a spoke.

A spool for a gas turbine engine according to an exemplary aspect of the present disclosure includes a first rotor disk defined along an axis of rotation and a plurality of first blades which extend from the first rotor disk. A rotor ring defined along the axis of rotation, the rotor ring in contact with the first rotor disk and a plurality of core gas path seals which extend from the rotor ring, the plurality of core gas path seals adjacent the plurality of first blades, each of the plurality of core gas path seals extend from the rotor ring at an interface, the interface defined along a spoke.

A spool for a gas turbine engine according to an exemplary aspect of the present disclosure includes a first rotor disk defined along an axis of rotation and a plurality of first blades which extend from said first rotor disk, each of said plurality of blades extend from said first rotor disk at an interface. A second rotor disk defined along said axis of rotation and a plurality of second blades which extend from said second rotor disk, each of said plurality of second blades extend from said second rotor disk at an interface. A rotor ring defined along said axis of rotation, said rotor ring in contact with said first rotor disk and said second rotor disk and a plurality of core gas path seals which extend from said rotor ring between said plurality of first blades and said plurality of second blades, each of said plurality of core gas path seals extend from said rotor ring at an interface, said interface defined along a spoke.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
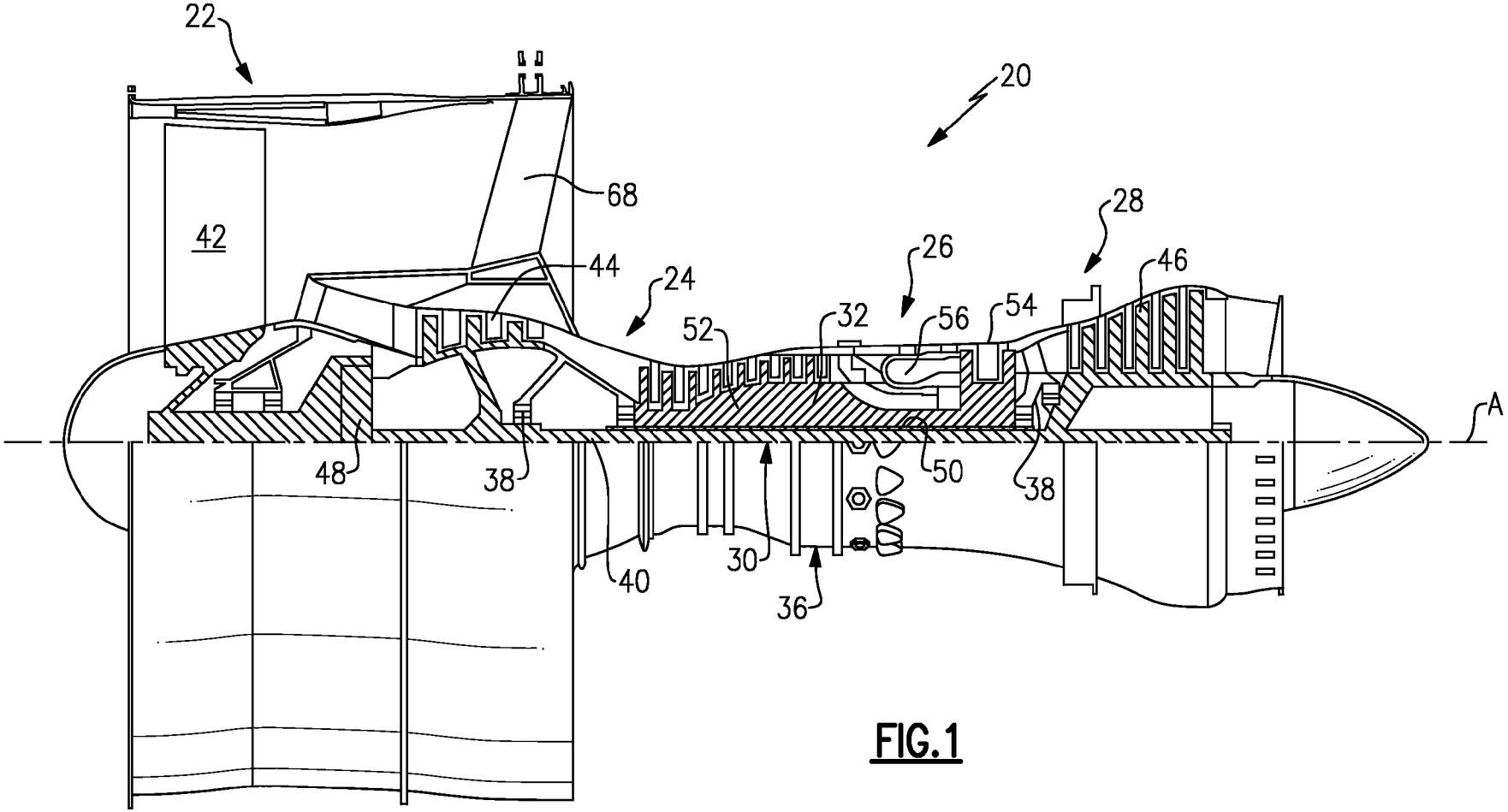
FIG. 1 is a schematic cross-sectional view of a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flowpath while the compressor section 24 drives air along a core flowpath for compression and communication into the combustor section 26 then expansion through the turbine section 28. Although depicted as a turbofan gas turbine engine in the disclosed non-limiting embodiment, it should be understood that the concepts described herein are not limited to use with turbofans as the teachings may be applied to other types of turbine engines, such as three-spool architectures.

The engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided.

The low speed spool 30 generally includes an inner shaft 40 that interconnects a fan 42, a low pressure compressor 44 and a low pressure turbine 46. The inner shaft 40 may be connected to the fan 42 directly or through a geared architecture 48 to drive the fan 42 at a lower speed than the low speed spool 30 which in one disclosed non-limiting embodiment includes a gear reduction ratio reduction ratio of, for example, at least 2.4:1. The high speed spool 32 includes an outer shaft 50 that interconnects a high pressure compressor (HPC) 52 and high pressure turbine (HPT) 54. A combustor 56 is arranged between the high pressure compressor 52 and the high pressure turbine 54. The inner shaft 40 and the outer shaft 50 are concentric and rotate about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The turbines 54, 46 rotationally drive the respective low speed spool 30 and high speed spool 32 in response to the expansion.

Figure 2:
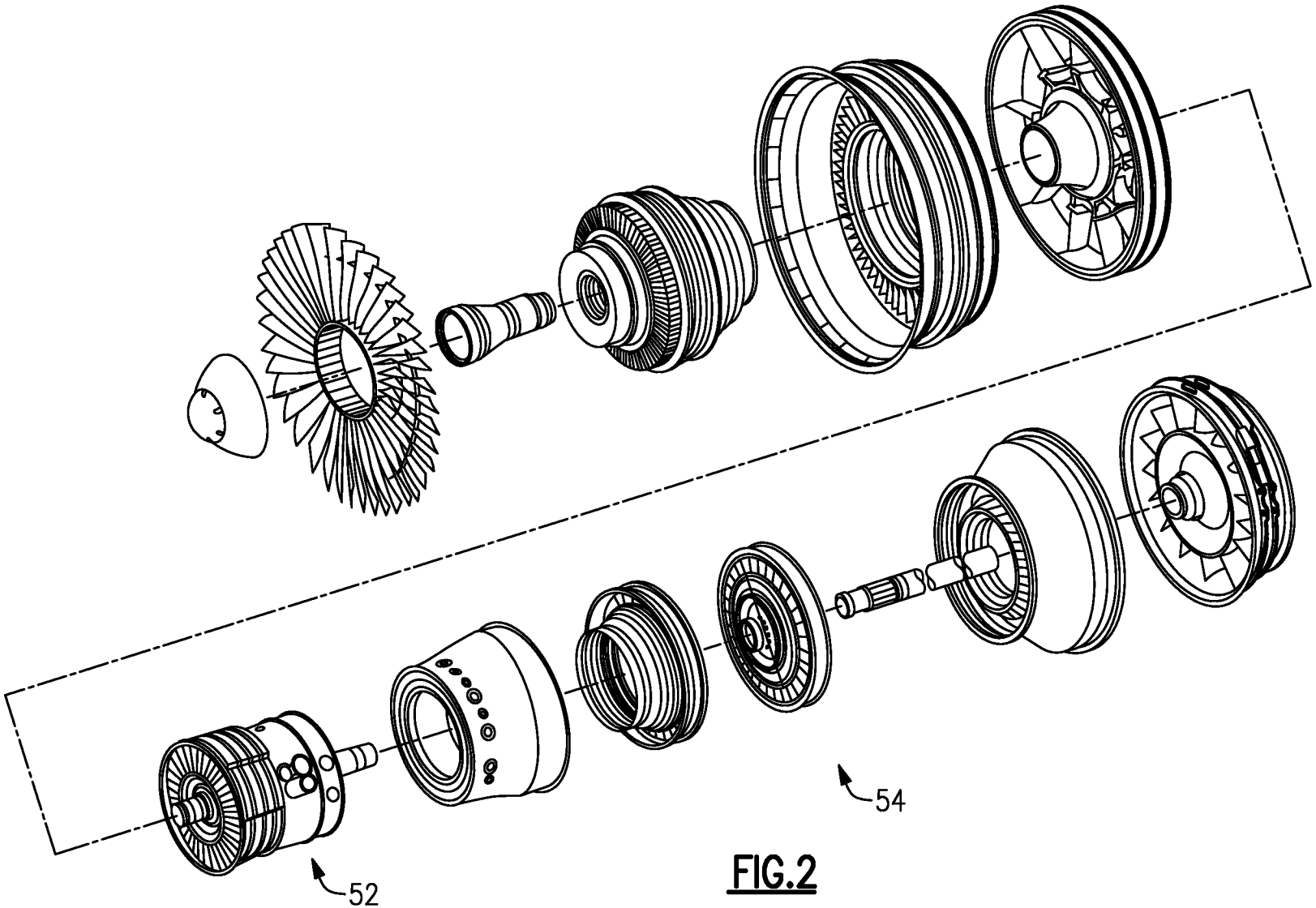
FIG. 2 is an exploded view of the gas turbine engine separated into primary build modules.

The gas turbine engine 20 is typically assembled in build groups or modules (FIG. 2). In the illustrated embodiment, the high pressure compressor 52 includes eight stages and the high pressure turbine 54 includes two stages in a stacked arrangement. It should be appreciated, however, that any number of stages will benefit hereform as well as other engine sections such as the low pressure compressor 44 and the low pressure turbine 46. Further, other gas turbine architectures such as a three-spool architecture with an intermediate spool will also benefit herefrom as well.

Figure 3:
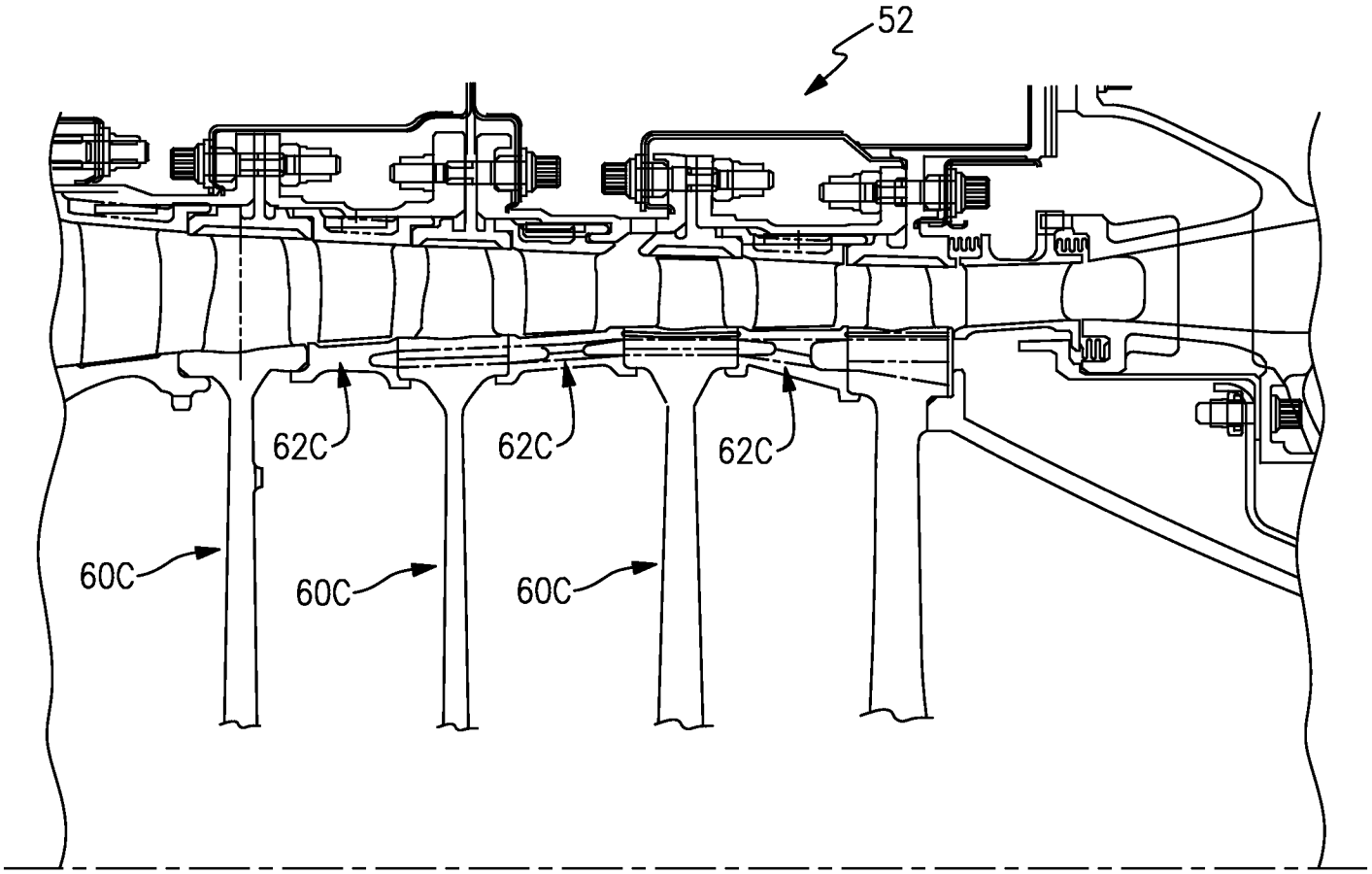
FIG. 3 is an enlarged schematic cross-sectional view of a high pressure compressor section of the gas turbine engine.

With reference to FIG. 3, the high pressure compressor (HPC) 52 is assembled from a plurality of successive HPC rotors 60C which alternate with HPC spacers 62C arranged in a stacked configuration. The rotor stack may be assembled in a compressed tie-shaft configuration, in which a central shaft (not shown) is assembled concentrically within the rotor stack and secured with a nut (not shown), to generate a preload that compresses and retains the HPC rotors 60C with the HPC spacers 62C together as a spool. Friction at the interfaces between the HPC rotor 60C and the HPC spacers 62C is solely responsible to prevent rotation between adjacent rotor hardware.

Figure 4:
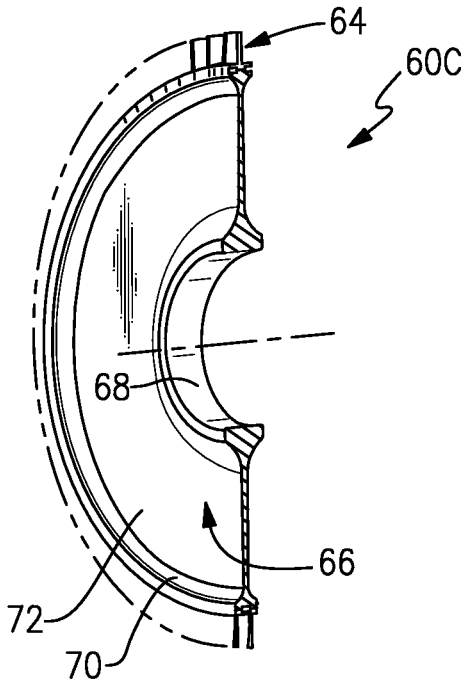
FIG. 4 is a perspective view of a rotor of the high pressure compressor section.

With reference to FIG. 4, each HPC rotor 60C generally includes a plurality of blades 64 circumferentially disposed around a rotor disk 66. The rotor disk 66 generally includes a hub 68, a rim 70, and a web 72 which extends therebetween. Each blade 64 generally includes an attachment section 74, a platform section 76 and an airfoil section 78 (FIG. 5).

The HPC rotor 60C may be a hybrid dual alloy integrally bladed rotor (IBR) in which the blades 64 are manufactured of one type of material and the rotor disk 66 is manufactured of different material. Bi-metal construction provides material capability to separately address different temperature requirements. For example, the blades 64 are manufactured of a single crystal nickel alloy that are transient liquid phase bonded with the rotor disk 66 which is manufactured of a different material such as an extruded billet nickel alloy. Alternatively, or in addition to the different materials, the blades 64 may be subject to a first type of heat treat and the rotor disk 66 to a different heat treat. That is, the Bi-metal construction as defined herein includes different chemical compositions as well as different treatments of the same chemical compositions such as that provided by differential heat treatment.

Figure 5:
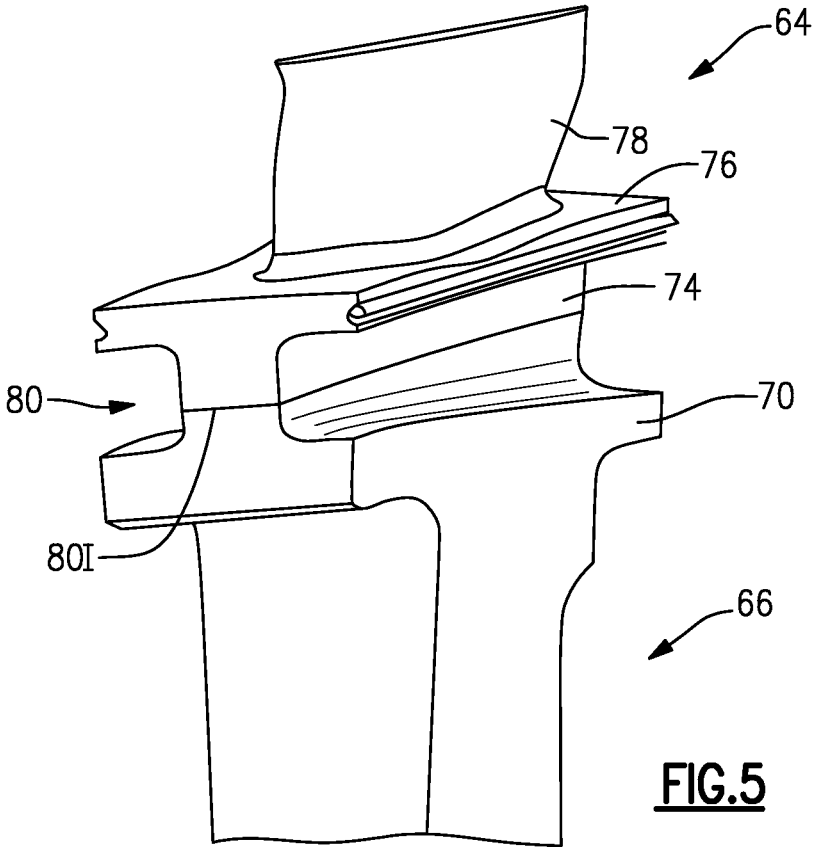
FIG. 5 is an expanded partial sectional perspective view of the rotor of FIG. 4.

With reference to FIG. 5, a spoke 80 is defined between the rim 70 and the attachment section 74. The spoke 80 is a circumferentially reduced section defined by interruptions which produce axial or semi-axial slots which flank each spoke 80. The spokes 80 may be machined, cut with a wire EDM or other processes to provide the desired shape. An interface 801 that defines the transient liquid phase bond and or heat treat transition between the blades 64 and the rotor disk 66 are defined within the spoke 80. That is, the spoke 80 contains the interface 801. Heat treat transition as defined herein is the transition between differential heat treatments.

The spoke 80 provides a reduced area subject to the thermo-mechanical fatigue (TMF) across the relatively high temperature gradient between the blades 64 which are within the relatively hot core gas path and the rotor disk 66 which is separated therefrom and is typically cooled with a secondary cooling airflow.

Figure 6:
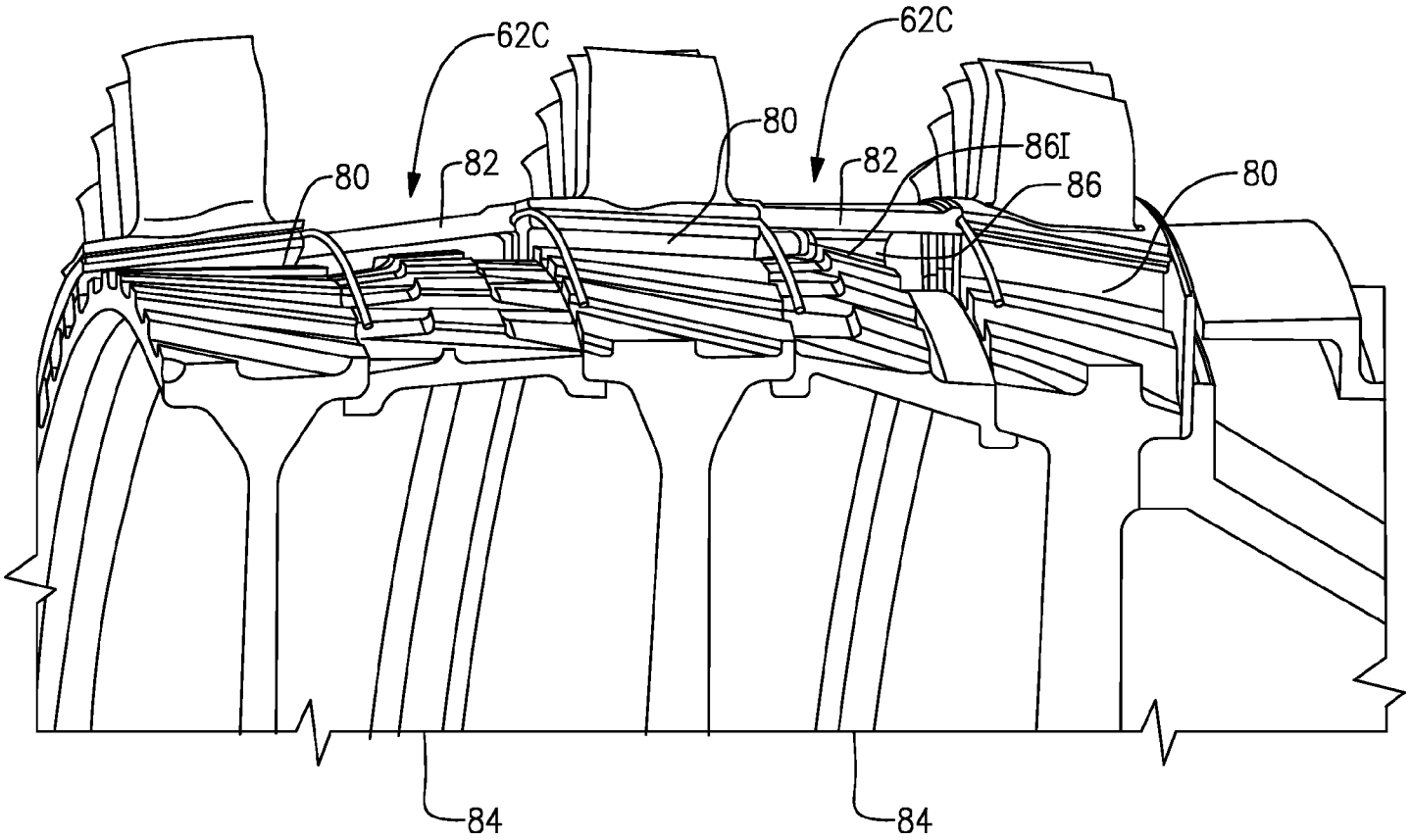
FIG. 6 is an expanded partial sectional perspective view of a portion of the high pressure compressor section.

With reference to FIG. 6, the HPC spacers 62C provide a similar architecture to the HPC rotor 60C in which a plurality of core gas path seals 82 are bonded or otherwise separated from a rotor ring 84 at an interface 861 defined along a spoke 86. In one example, the seals 82 may be manufactured of the same material as the blades 64 and the rotor ring 84 may be manufactured of the same material as the rotor disk 66. That is, the HPC spacers 62C may be manufactured of a hybrid dual alloy which are transient liquid phase bonded at the spoke 86. Alternatively, the HPC spacers 62C may be manufactured of a single material but subjected to the differential heat treat which transitions within the spoke 86. In another disclosed non-limiting embodiment, a relatively low-temperature configuration will benefit from usage of a single material such that the spokes 86 facilitate a weight reduction. In another disclosed non-limiting embodiment, low-temperature bi-metal designs may further benefit from dissimilar materials for weight reduction where, for example, low density materials may be utilized where load carrying capability is less critical.

The rotor geometry provided by the spokes 80, 86 reduces the transmission of core gas path temperature via conduction to the rotor disk 66 and the seal ring 84. The spokes 80, 86 enable an IBR rotor to withstand increased T3 levels with currently available materials. Rim cooling may also be reduced from conventional allocations. In addition, the overall configuration provides weight reduction at similar stress levels to current configurations.

The spokes 80, 86 in the disclosed non-limiting embodiment are oriented at a slash angle with respect to the engine axis A to minimize windage and the associated thermal effects. That is, the spokes are non-parallel to the engine axis A.

Figure 7:
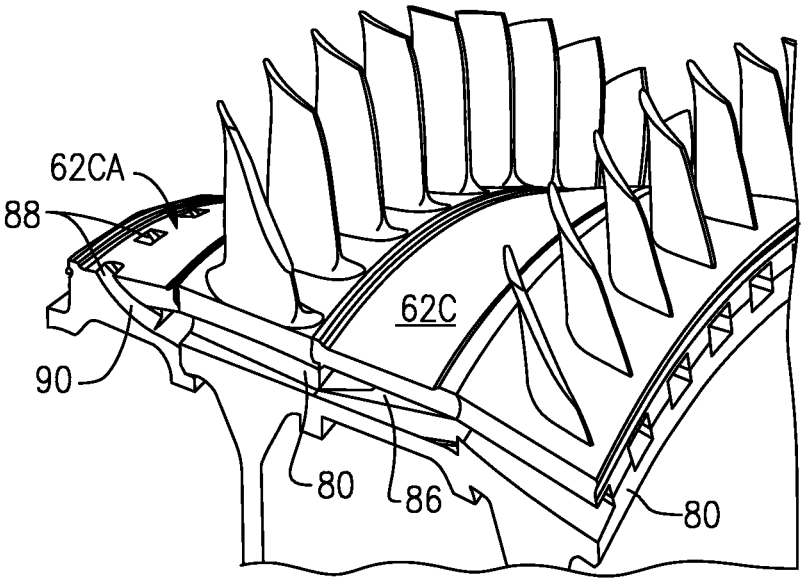
FIG. 7 is a top partial sectional perspective view of a portion of the high pressure compressor section with an outer directed inlet.

With reference to FIG. 7, the passages which flank the spokes 80, 86 may also be utilized to define airflow paths to receive an airflow from an inlet HPC spacer 62CA. The inlet HPC spacer 62CA includes a plurality of inlets 88 which may include a ramped flow duct 90 to communicate an airflow into the passages defined between the spokes 80, 86. The airflow may be core gas path flow which is communicated from an upstream, higher pressure stage for use in a later section within the engine such as the turbine section 28.

It should be appreciated that various flow paths may be defined through combinations of the inlet HPC spacers 62CA to include but not limited to, core gas path flow communication, secondary cooling flow, or combinations thereof. The airflow may be communicated not only forward to aft toward the turbine section, but also aft to forward within the engine 20. Further, the airflow may be drawn from adjacent static structure such as vanes to effect boundary flow turbulence as well as other flow conditions. That is, the HPC spacers 62C and the inlet HPC spacer 62CA facilitate through-flow for use in rim cooling, purge air for use downstream in the compressor, turbine, or bearing compartment operation.

Figure 8:
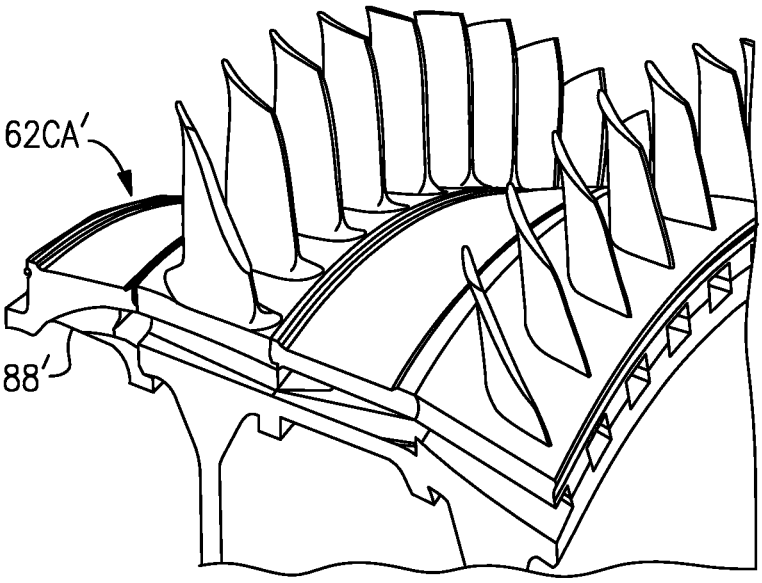
FIG. 8 is a top partial sectional perspective view of a portion of the high pressure compressor section with an inner directed inlet.

In another disclosed non-limiting embodiment, the inlets 88' may be located through the inner diameter of an inlet HPC spacer 62CA' (FIG. 8). The inlet HPC spacer 62CA' may be utilized to, for example, communicate a secondary cooling flow along the spokes 80, 86 to cool the spokes 80, 86 as well as communicate secondary cooling flow to other sections of the engine 20.

In another disclosed non-limiting embodiment, the inlets 88, 88' may be arranged with respect to rotation to essentially "scoop" and further pressurize the flow. That is, the inlets 88, 88' include a circumferential directional component.

Figure 9:
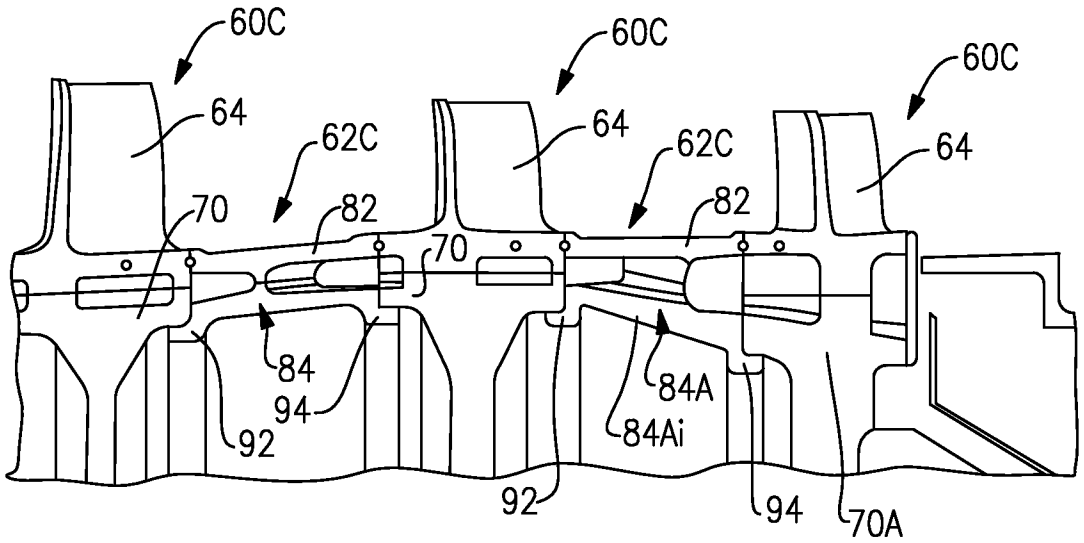
FIG. 9 is an expanded partial sectional view of a portion of the high pressure compressor section.

With reference to FIG. 9, each rotor ring 84 defines a forward circumferential flange 92 and an aft circumferential flange 94 which is captured radially inboard of the associated adjacent rotor rim 70. That is, each rotor ring 84 is captured therebetween in the stacked configuration. In the disclosed tie-shaft configuration with multi-metal rotors, the stacked configuration is arranged to accommodate the relatively lower-load capability alloys on the core gas path side of the rotor hardware, yet maintain the load-carrying capability between the seal rings 84' and the rims 70 to transmit rotor torque.

That is, the alternating rotor rim 70 to seal ring 84 configuration carries the rotor stack preload—which may be upward of 150,000 lbs—through the high load capability material of the rotor rim 70 to seal ring 84 interface, yet permits the usage of a high temperature resistant, yet lower load capability materials in the blades 64 and the seal surface 82 which are within the high temperature core gas path. Divorce of the sealing area from the axial rotor stack load path facilitates the use of a disk-specific alloy to carry the stack load and allows for the high-temp material to only seal the rotor from the flow path. That is, the inner diameter loading and outer diameter sealing permits a segmented airfoil and seal platform design which facilitates relatively inexpensive manufacture and highly contoured airfoils. The disclosed rotor arrangement facilitates a compressor inner diameter bore architectures in which the reduced blade/platform pull may be taken advantage of in ways that produce a larger bore inner diameter to thereby increase shaft clearance.

Figure 10:
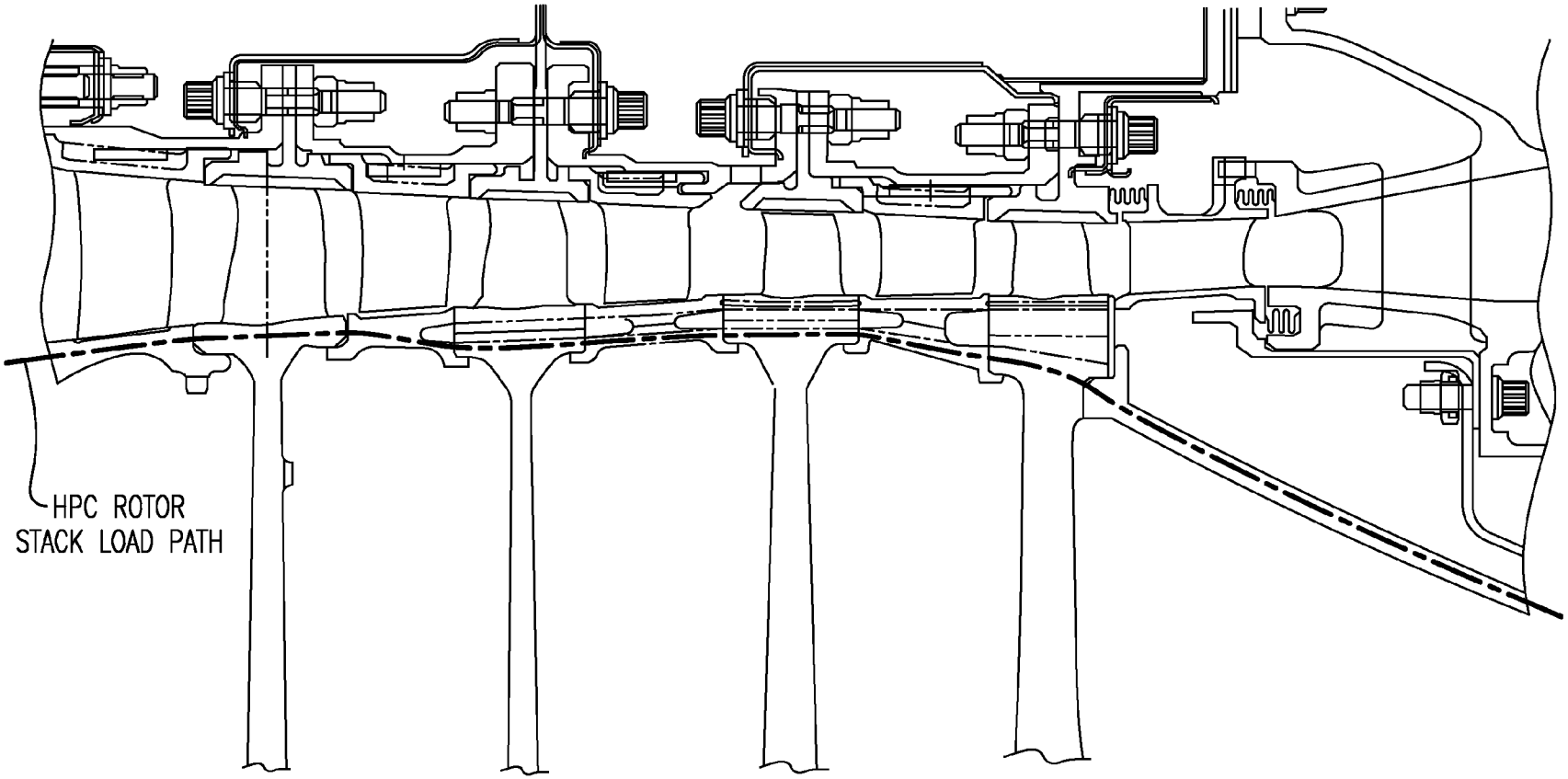
FIG. 10 is an expanded partial sectional perspective view of a portion of the high pressure compressor section illustrating a rotor stack load path.
Figure 11:
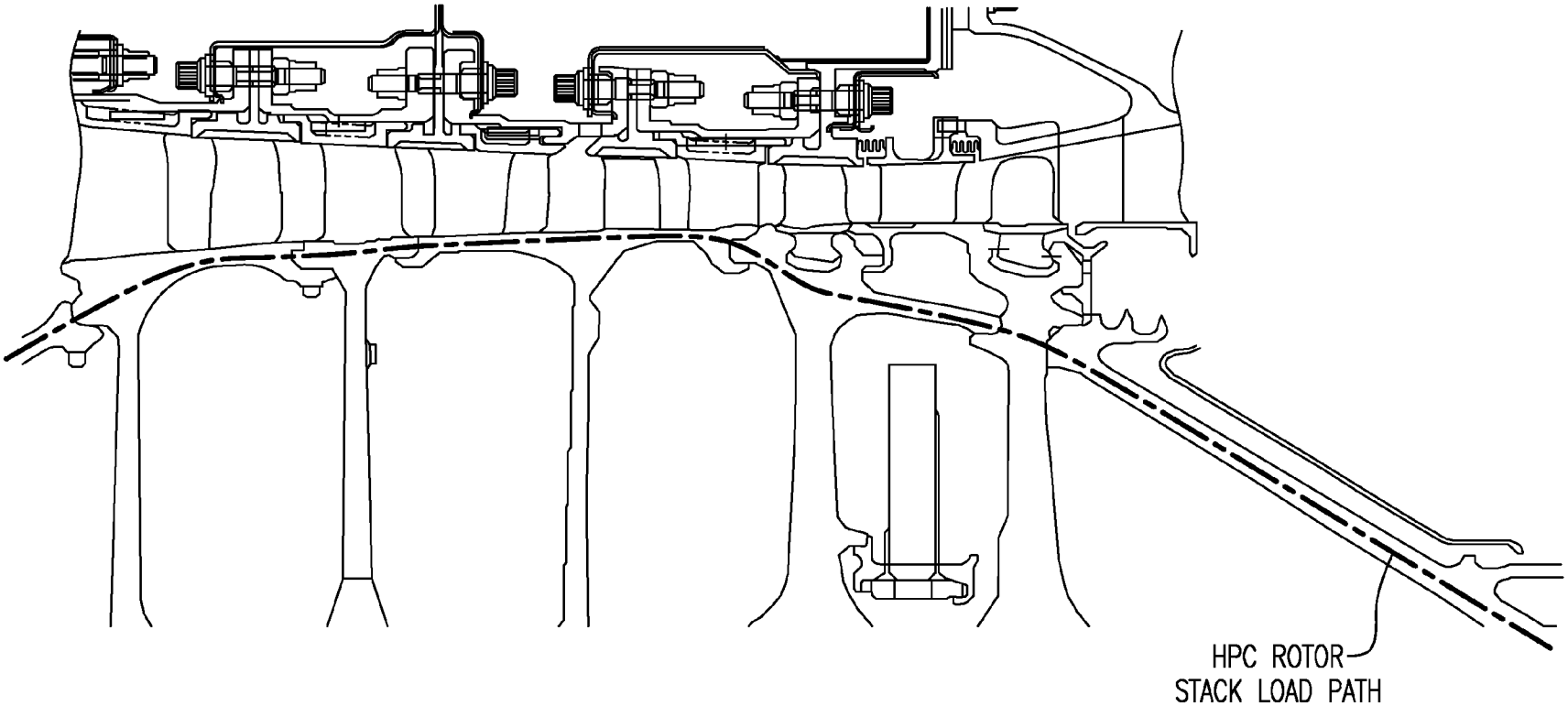
FIG.11 Related Art
FIG. 11 is a RELATED ART expanded partial sectional perspective view of a portion of the high pressure compressor section illustrating a more tortuous rotor stack load path.

The HPC spacers 62C and HPC rotors 60C of the IBR may also be axially asymmetric to facilitate a relatively smooth axial rotor stack load path (FIG. 10). The asymmetry may be located within particular rotor rims 70A and/or seal rings 84A. For example, the seal ring 84A includes a thinner forward circumferential flange 92 compared to a thicker aft circumferential flange 94 with a ramped interface 84Ai. The ramped interface 84Ai provides a smooth rotor stack load path. Without tangentially slot assembled airfoils in an IBR, the load path along the spool may be designed in a more efficient manner as compared to the heretofore rather torturous conventional rotor stack load path (FIG. 11; RELATED ART).

Figure 12:
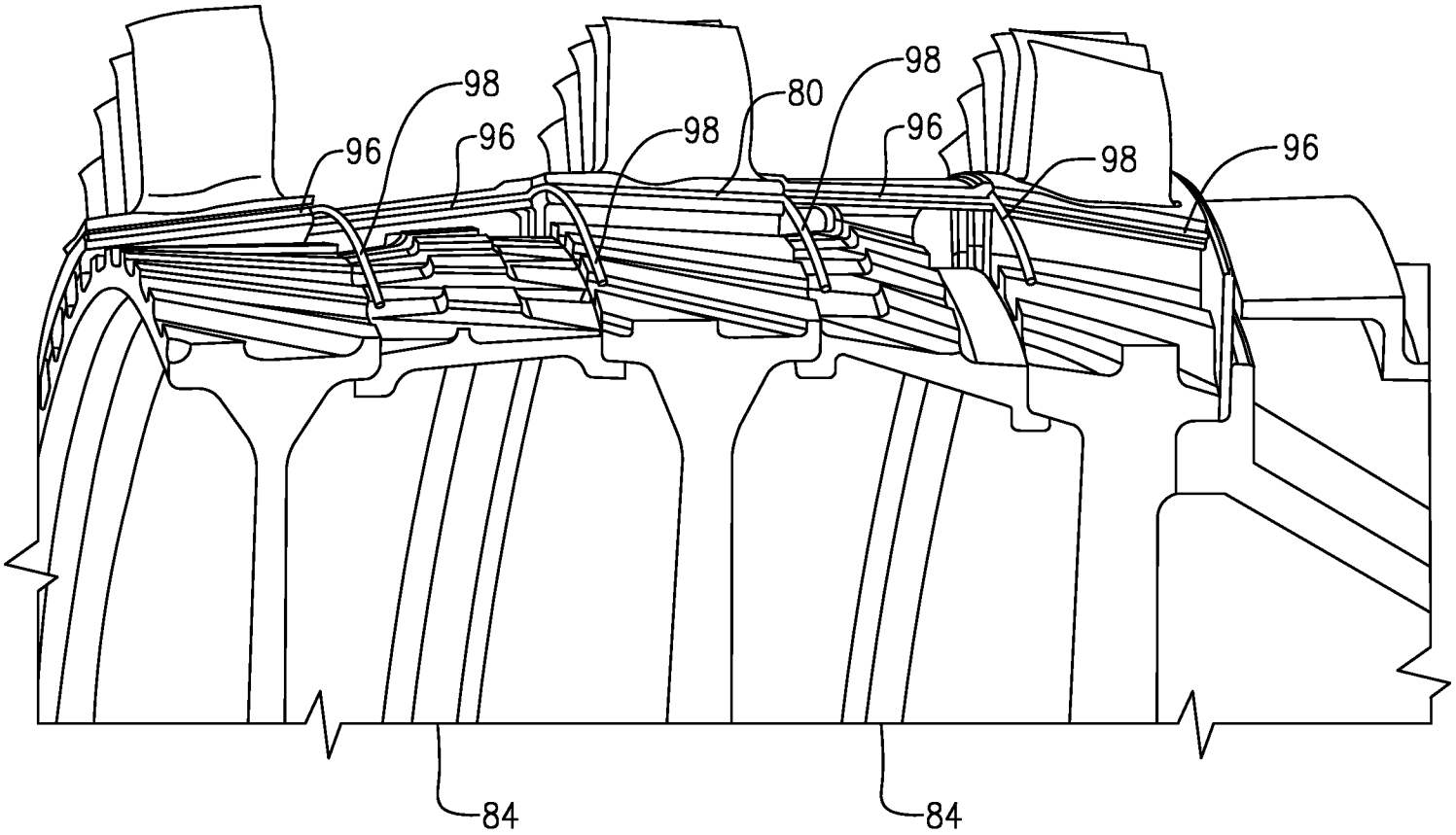
FIG. 12 is an expanded partial sectional perspective view of a portion of the high pressure compressor section illustrating a wire seal structure.
Figure 13:
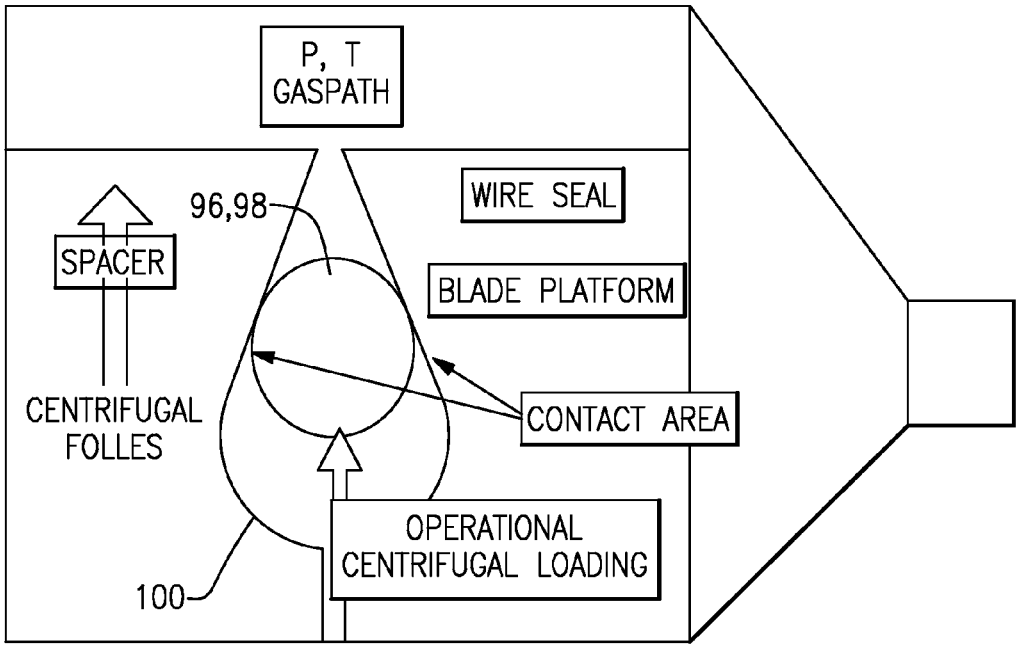
FIG. 13 is an expanded schematic view of the wire seal structure.

With reference to FIG. 12, the blades 64 and seal surface 82 may be formed as segments that include tangential wire seals 96 between each pair of the multiple of seal surfaces 82 and each pair of the multiple of blades 64 as well as axial wire seals 98 between the adjacent HPC spacers 62C and HPC rotors 60C. The tangential wire seals 96 and the axial wire seals 98 are located within teardrop shaped cavities 100 (FIG. 13) such that centrifugal forces increase the seal interface forces.

Although the high pressure compressor (HPC) 52 is discussed in detail above, it should be appreciated that the high pressure turbine (HPT) 54 (FIG. 14) is similarly assembled from a plurality of successive respective HPT rotor disks 60T which alternate with HPT spacers 62T (FIG. 15) arranged in a stacked configuration and the disclosure with respect to the high pressure compressor (HPC) 52 is similarly applicable to the high pressure turbine (HPT) 54 as well as other spools of the gas turbine engine 20 such as a low spool and an intermediate spool of a three-spool engine architecture. That is, it should be appreciated that other sections of a gas turbine engine may alternatively or additionally benefit herefrom.

Figure 14:
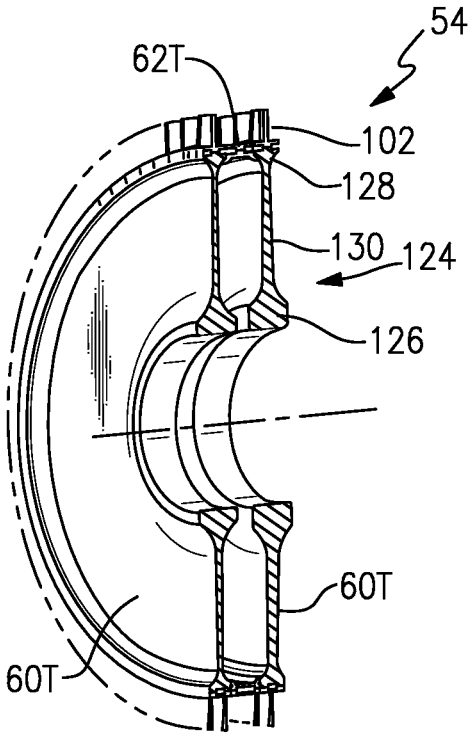
FIG. 14 is an expanded partial sectional perspective view of a high pressure turbine section.
Figure 16:
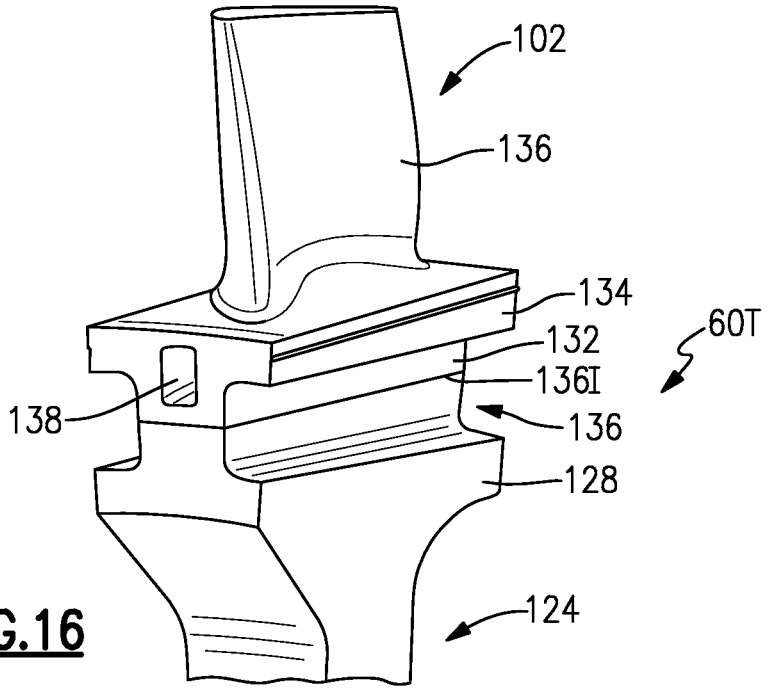
FIG. 16 is an expanded partial sectional perspective view of the rotor of FIG. 15.
Figure 15:
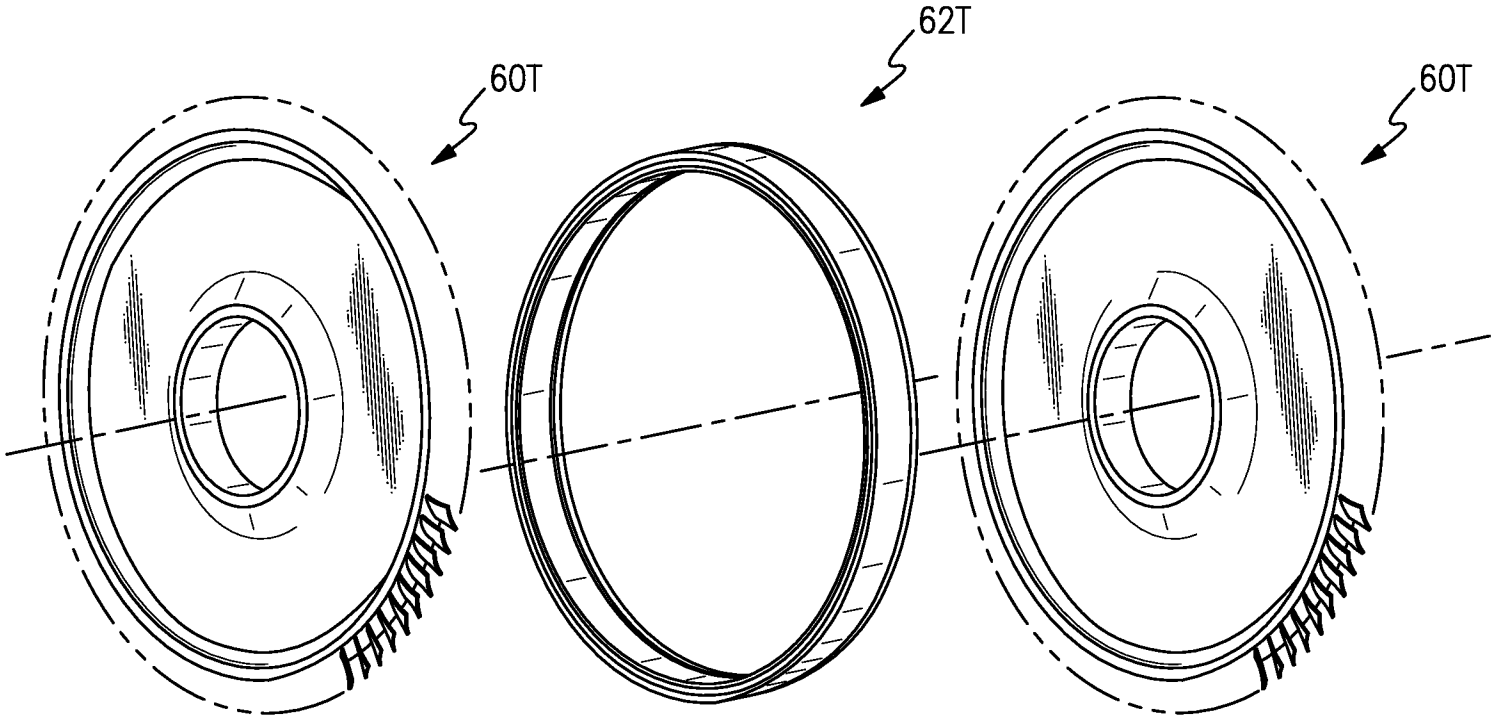
FIG. 15 is an expanded exploded view of the high pressure turbine section.

With reference to FIG. 14, each HPT rotor 60T generally includes a plurality of blades 102 circumferentially disposed around a rotor disk 124. The rotor disk 124 generally includes a hub 126, a rim 128, and a web 130 which extends therebetween. Each blade 102 generally includes an attachment section 132, a platform section 134, and an airfoil section 136 (FIG. 16).

The blades 102 may be bonded to the rim 128 along a spoke 136 at an interface 1361 as with the high pressure compressor (HPC) 52. Each spoke 136 also includes a cooling passage 138 generally aligned with each turbine blade 102. The cooling passage 138 communicates a cooling airflow into internal passages (not shown) of each turbine blade 102.

It should be understood that like reference numerals identify corresponding or similar elements throughout the several drawings. It should also be understood that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed is:

1. A spacer for a gas turbine engine comprising:

a rotor ring defined along an axis of rotation; and a plurality of core gas path seals which extend from said rotor ring, each of said plurality of core gas path seals extend from said rotor ring at an interface, said interface defined along a spoke, and wherein said interface includes a heat treat transition.

2. The rotor as recited in claim 1, wherein said rotor ring is manufactured of a first material and said plurality of core gas path seals are manufactured of a second material, said first material different than said second material.

3. The spacer as recited in claim 1, wherein each spoke is parallel to said axis of rotation.

4. The spacer as recited in claim 1, wherein each spoke is angled with respect to said axis of rotation.

5. The spacer as recited in claim 1, wherein at least one of said plurality of core gas path seals includes an inlet.

6. The spacer as recited in claim 5, wherein said inlet is to a passage adjacent to said spoke.

7. A spacer for a gas turbine engine comprising:

a rotor ring defined along an axis of rotation; and a plurality of core gas path seals which extend from said rotor ring, each of said plurality of core gas path seals extend from said rotor ring at an interface, said interface defined along a spoke, and wherein said interface includes a bond.

8. A spacer for a gas turbine engine comprising:

a rotor ring defined along an axis of rotation and wherein said ring defines a first circumferential flange and a second circumferential flange, said second circumferential flange thicker than said first circumferential flange, and further comprising a ramped interface between said second circumferential flange and said first circumferential flange; and a plurality of core gas path seals which extend from said rotor ring, each of said plurality of core gas path seals extend from said rotor ring at an interface, said interface defined along a spoke.

9. A spool for a gas turbine engine comprising:

a first rotor disk defined along an axis of rotation;

a plurality of first blades which extend from said first rotor disk;

a rotor ring defined along said axis of rotation, said rotor ring in contact with said first rotor disk;

a plurality of core gas path seals which extend from said rotor ring, said plurality of core gas path seals adjacent said plurality of first blades, each of said plurality of core gas path seals extend from said rotor ring at an interface, said interface defined along a spoke; and a first circumferential wire seal between said plurality of core gas path seals and said plurality of first blades.

10. The spool as recited in claim 9, further comprising a wire seal between each pair of said plurality of core gas path seals.

11. The spool as recited in claim 9, wherein said plurality of core gas path seals interface with a platform of said plurality of first blades.

12. The spool as recited in claim 9, wherein each spoke is parallel to said axis of rotation.

13. The spool as recited in claim 9, wherein each spoke is angled with respect to said axis of rotation.

14. A spool for a gas turbine engine comprising:

a first rotor disk defined along an axis of rotation;

a plurality of first blades which extend from said first rotor disk, each of said plurality of blades extend from said first rotor disk at a first interface, said first interface defined along a first spoke;

a second rotor disk defined along said axis of rotation;

a plurality of second blades which extend from said second rotor disk, each of said plurality of second blades extend from said second rotor disk at a second interface, said second interface defined along a second spoke;

a rotor ring defined along said axis of rotation, said rotor ring in contact with said first rotor disk and said second rotor disk; and a plurality of core gas path seals which extend from said rotor ring between said plurality of first blades and said plurality of second blades, each of said plurality of core gas path seals extend from said rotor ring at a third interface, said third interface defined along a third spoke, and wherein at least one of said plurality of core gas path seals includes an inlet in communication with a passage in communication with said second spoke and said first spoke.

15. The spool as recited in claim 14, wherein said first spoke, said second spoke and said third spoke are axially aligned.

16. A spool for a gas turbine engine comprising:

a first rotor disk defined along an axis of rotation;

a plurality of first blades which extend from said first rotor disk, each of said plurality of blades extend from said first rotor disk at a first interface, said first interface defined along a first spoke;

a second rotor disk defined along said axis of rotation;

a plurality of second blades which extend from said second rotor disk, each of said plurality of second blades extend from said second rotor disk at a second interface, said second interface defined along a second spoke;

a rotor ring defined along said axis of rotation, said rotor ring in contact with said first rotor disk and said second rotor disk;

a plurality of core gas path seals which extend from said rotor ring between said plurality of first blades and said plurality of second blades, each of said plurality of core gas path seals extend from said rotor ring at a third interface, said third interface defined along a third spoke; and a first circumferential wire seal between said plurality of core gas path seals and said plurality of first blades and a second circumferential wire seal between said plurality of core gas path seals and said plurality of second blades.

* * * * *